US005237813A

United States Patent [19]

Harris et al.

[11] Patent Number: 5,237,813

[45] Date of Patent: Aug. 24, 1993

[54] ANNULAR COMBUSTOR WITH OUTER TRANSITION LINER COOLING

[75] Inventors: Mark M. Harris; David N. Marsh, both of Phoenix, Ariz.

[73] Assignee: Allied-Signal Inc., Morris Township, Morris County, N.J.

[21] Appl. No.: 934,053

[22] Filed: Aug. 21, 1992

[51] Int. Cl.[5] ..... F02C 3/06

[52] U.S. Cl. ..... 60/39.36; 60/752; 60/760

[58] Field of Search ..... 60/39.36, 760, 752, 60/754

[56] References Cited

U.S. PATENT DOCUMENTS

| | | | |
|---|---|---|---|
| 3,613,360 | 10/1971 | Howes . | |
| 3,691,766 | 9/1972 | Champion | 60/39.65 |
| 3,844,116 | 10/1974 | Matto | 60/760 |
| 3,869,864 | 3/1975 | Bunn | 60/39.65 |
| 4,339,925 | 7/1982 | Eggmann et al. | 60/758 |
| 4,573,315 | 3/1986 | Stroem | 60/39.37 |
| 4,928,479 | 5/1990 | Shekleton et al. | 60/39.36 |
| 4,993,220 | 2/1991 | Shekleton et al. | 60/39.36 |
| 5,000,005 | 3/1991 | Kwan et al. | 60/757 |
| 5,012,645 | 5/1991 | Reynolds | 60/754 |
| 5,033,263 | 7/1991 | Shekleton et al. | 60/39.32 |
| 5,058,375 | 10/1991 | Sheketon et al. | 60/39.36 |
| 5,062,262 | 11/1991 | Shekleton et al. | 60/39.36 |

*Primary Examiner*—Richard A. Bertsch
*Assistant Examiner*—W. J. Wicker
*Attorney, Agent, or Firm*—Jerry J. Holden; Robert A. Walsh

[57] ABSTRACT

A reverse flow annular combustor is provided having downstream wall comprised of a shroud covering the outer surface of the outer transition liner. The shroud abuts the transition liner at a plurality of points to define a plurality of passages between the shroud and the liner. The passages receiving cooling through the shroud at its radial inner end and expel the cooling air through the liner at its outer radial portion and into the hot gas in the combustor. Thus, the air used to cool the liner is also used for dilution mixing with the combustion gas.

7 Claims, 3 Drawing Sheets

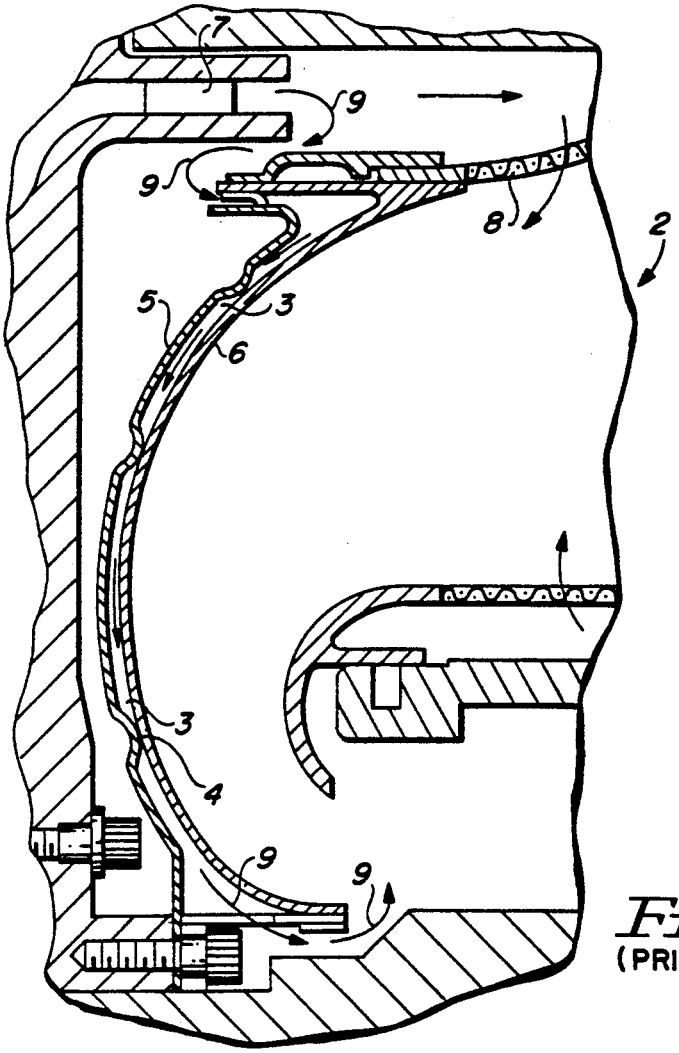
FIG. 1
(PRIOR ART)
FIG. 4
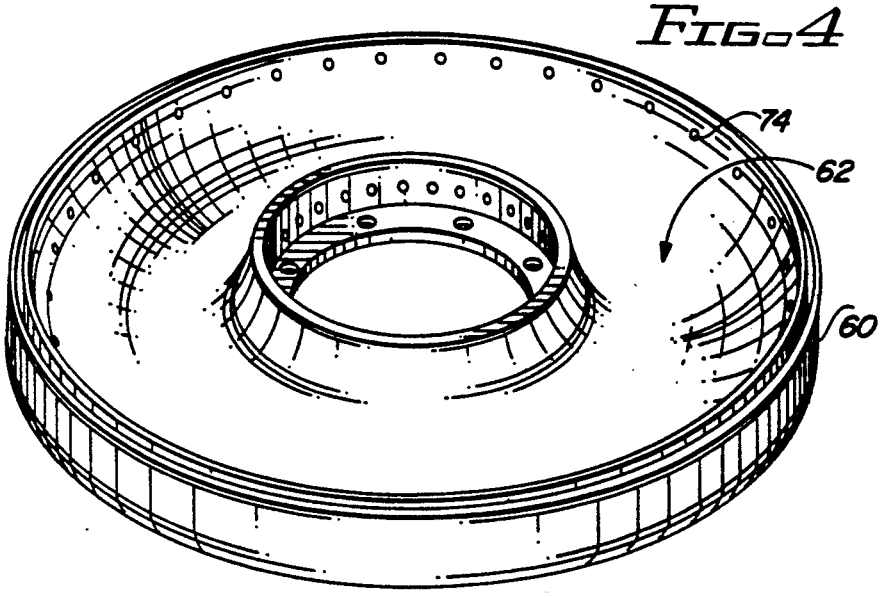

ANNULAR COMBUSTOR WITH OUTER TRANSITION LINER COOLING

GOVERNMENT RIGHTS

This invention was made with Government support under contract F33615-87-C-2807 awarded by the United States Air Force. The Government has certain rights in this invention.

TECHNICAL FIELD

This invention relates to gas turbine engine combustors, and in particular, to a reverse flow annular combustor having an outer transition liner in which cooling air flows from the liner's center to its perimeter where it exits into the combustor discharge flow where it is used as dilution air to control the combustor exit temperature distribution.

BACKGROUND OF THE INVENTION

FIG. 1 shows a portion of a prior art reverse flow annular combustion chamber designated by reference numeral-conventional downstream wall 4 is comprised of a shroud 5 disposed about a liner 6 which is referred to as the outer transition liner. The liner 6 is attached to a combustor wall 8 which has a plurality of holes for injection cooling air for dilution mixing with the hot combustion gas. Dilution mixing of this cool air with the hot combustion gas immediately downstream of the flame zone is well known in the art. The dilution air is used to properly mix the hot gas, thus eliminating hot spots or streaks in the gas flow and assuring a uniform temperature profile. During combustion, the liner 6 is exposed to the hot gas exiting the combustion chamber and therefore requires cooling. This cooling is provided by a portion of the high momentum air exiting the compressor 7, represented by arrows 9, which flows through the cooling passages 3 in a radially inward, (i.e. towards the engine centerline) direction exiting as low momentum air at the inner portion of the liner 6 and is then dumped into the gas stream upstream of the first stage turbine stator, not shown.

As gas turbine engine technology advances, these engines are required to operate at higher pressure ratios and higher combustor exit temperatures. To attain these higher temperatures requires high fuel/air ratios in the combustor. As a result, these combustors use up most of the air exiting the compressor in the combustion process, leaving only a small amount of air, if any, for cooling the outer transition liner of the combustor and for dilution mixing with the combustion hot gas.

Accordingly, there is a need for a combustor in which the air used for cooling the outer transition liner is also used for dilution mixing.

SUMMARY OF THE INVENTION

An object of the present invention is to provide a combustor with a downstream wall having an interior arrangement of passages that allow cooling air to pass across the outer transition liner and then be used for dilution mixing of the hot gas exiting the combustor.

The present invention achieves the above-stated objects by providing a combustor having a downstream wall with an interior arrangement of passages that receive cooling air at the wall's radially inner portion and expels the cooling air at the wall's radially outer portion into the combustor exhaust gases where it is used for dilution mixing.

These and other objects, features and advantages of the present invention are specifically set forth in or will become apparent from the following detailed description of a preferred embodiment of the invention when read in conjunction with the accompanying drawing.

BRIEF DESCRIPTION OF THE DRAWINGS

FIG. 1 is a plan view of a portion of a prior art combustor.

FIG. 4 is a perspective view the interior or hot gas surface of the outer transition liner of FIG. 2.

DESCRIPTION OF THE PREFERRED EMBODIMENT

Figure 2:
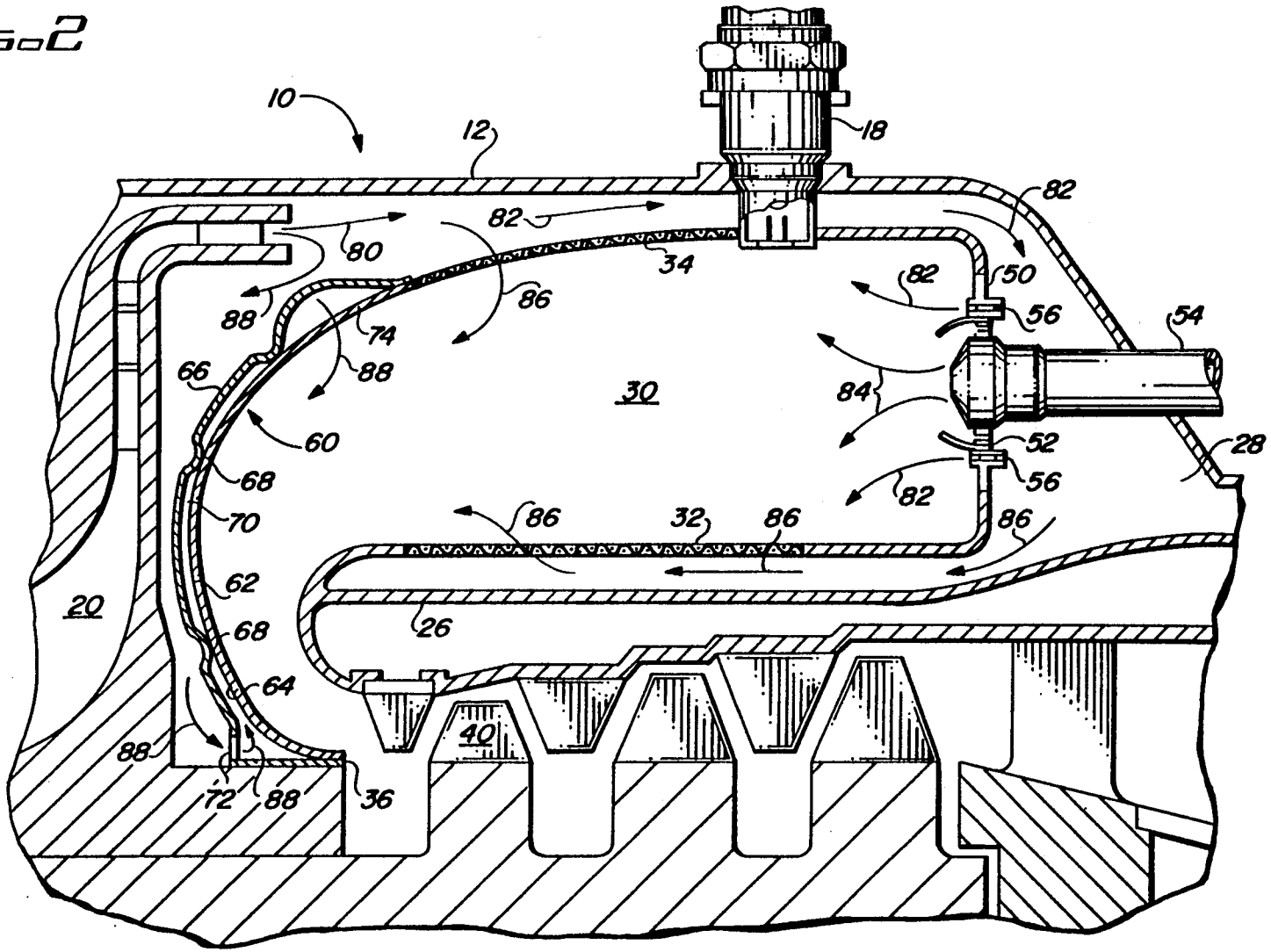
FIG. 2 is a plan view of a portion of a gas turbine engine having a combustor with an outer transition liner embodying the principles of the present invention.
Figure 3:
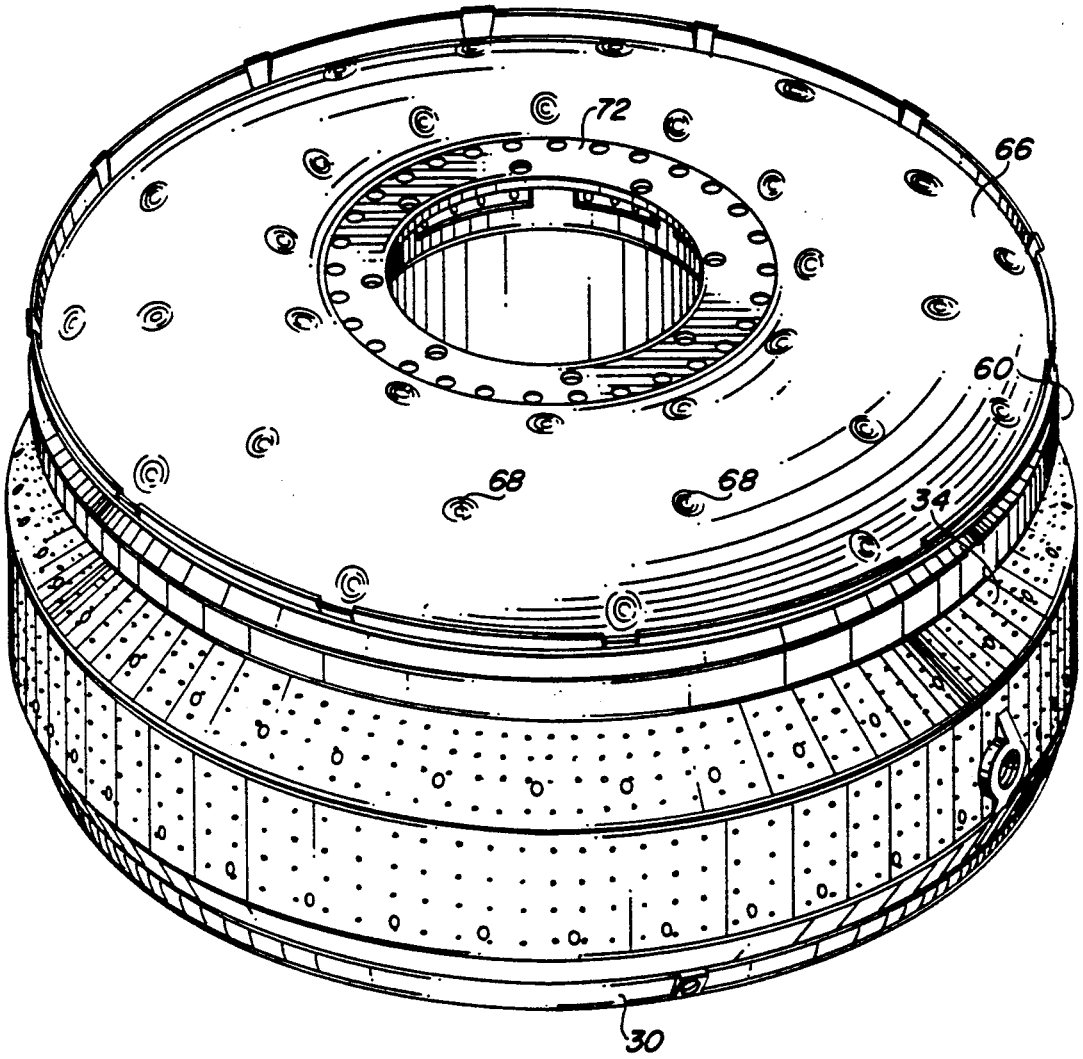
FIG. 3 is a perspective view of the combustor of FIG. 2

Referring to FIG. 2, a gas turbine engine to which the present invention relates is generally denoted by the reference numeral 10. The engine 10 operates in a conventional manner and includes an outer casing 12 circumscribing a centrifugal compressor 20 which discharges compressed air into a combustion section 28, that encircles an axial expansion turbine 40. Each of these components is annular and symmetric about the engine centerline.

The combustion section 28 includes an annular combustion chamber 30 mounted between an inner annular wall 26 and the casing 12, and supported from an anchor point 36 where it is attached to the main frame of the engine 10. The annular combustion chamber 30 is defined by a pair of radially spaced apart, perforated, cylindrical walls 32 and 34, an annular upstream wall 50, and an annular downstream wall 60. The combustion chamber 30 is sometimes referred to as a reverse flow chamber because the mean direction of flow within the chamber 30 is opposite the general direction of flow through the engine 10.

The annular upstream wall 50 is provided with a plurality of equi-circumferentially spaced apertures 52 and a fuel injector 54 is positioned coaxially in each of the apertures 52. The upstream wall 50 also has a plurality of passages 56 for supplying air to the combustion chamber 30. An igniter 18 is mounted to the casing 12 and extends through the wall 34 into the chamber 30.

As shown in FIG. 2, the downstream wall 60 is concave and is either attached to, or integral with the wall 34. The downstream wall 60 is comprised of an annular inner liner 62, referred to as the outer transition liner, and an annular shroud 66 disposed about the back surface 64 of the liner 62. The shroud 66 is spaced from the surface 64 except at plurality of points or dimples 68 at which the two abut. The dimples 68 define a plurality of cooling passages 60 between the liner 62 and the shroud 66. The cooling passages 70 receive air from a plurality of equi-circumferentially spaced holes 72 located at the inner radial portion of the shroud 66 and deliver air to a plurality of equi-circumferentially spaced holes 74 located at the outer radial portion of the liner 62. The holes 74 should be as large as possible without affecting the structural integrity of the liner 62 and their number is preferably an even multiple of the number of fuel injectors 54. Preferably, the holes 74 are placed as far upstream as possible. In the preferred embodiment, the holes 72 have a total area at least twice the total area of the holes 74. To maintain high heat transfer coefficients, the cooling passages 70 are sized to ensure that the velocity of the cooling air corresponds to a Mach number range of 0.15 to 0.25. To achieve these Mach numbers the gap between the surface 64 and shroud 66 is maintained between 0.030 to 0.080 inches. At the radially outer portion of the liner 62, the gap is enlarged to provide static pressure recovery to the cooling air before it passes into the combustion chamber 30.

In operation, the compressor 20 delivers compressed air as represented by arrow 80. A first portion, represented by arrows 82, of the compressed air flows around the combustor chamber 30 and enters through air holes 56 in the upstream wall 50. This then mixed with fuel represented by arrows 84 and ignited to form a hot gas. A second portion, represented by arrows 86, of the compressed air 80, flows through the perforated walls 32 and 34 and is used for dilution mixing of the hot gas. A third portion represented by arrows 88 flows radially inward towards the engine centerline and around the shroud 66. This air enters the cooling passages 70 through holes 72 and flows radially outward cooling the back surface 64 of the liner 62. This cooling air then enters the combustor chamber 30 through holes 74 where it is used for dilution mixing of the hot gas. Thus, a combustor is provided having a downstream wall with an internal configuration of cooling passages that allows for the same compressed air to be used for cooling the outer transition liner and for dilution mixing.

In order to test the effectiveness of the subject invention hot flow rig tests were conducted on a prior art combustor as illustrated in FIG. 1 and a combustor in accordance with the present invention. Table 1 summarizes the results of the test.

| TEST PARAMETER | PRIOR ART | PRESENT INVENTION |
|---|---|---|
| Average Exit Temperature, F. | 2208 | 2201 |
| Peak Temperature, F. | 2563 | 2425 |
| Pattern Factor (Temperature Spread Factor) | .22 | .15 |
| Percent of Total Air Flow Available for Dilution Mixing | 16.5 | 23.3 |

A comparison of the results shows that the present invention had lower peak temperatures than the prior art combustor. It also had a more uniform temperature distribution in the hot gas exiting the combustor as evidenced by the lower pattern factor than the prior art device. Thus, a combustor 30 in accordance with the present invention provides more air for dilution mixing than the prior art combustors while still sufficiently cooling the outer transition liner.

Various modifications and alterations to the above described invention will be apparent to those skilled in the art. Accordingly, the foregoing detailed description of the preferred embodiment of the invention should be considered exemplary in nature and not as limiting to the scope and spirit of the invention as set forth in the following claims.

What is claimed is:

1. A reverse flow annular combustor for a gas turbine engine having an upstream end and a downstream end comprising at least one annular wall, extending radially from an inner end to an outer end which is upstream of said inner end, said wall disposed at said downstream end of said combustor and having an interior surface exposed to the hot gas in said combustor, and an annular shroud disposed about an exterior surface of said angular wall and abutting thereto at a plurality of points thereby defining a plurality of passages between said wall and shroud, said passages receiving air through a plurality of holes through the inner radial end of said shroud and delivering air to a plurality of apertures through the outer radial end of said wall.

2. The combustor of claim 1 wherein said wall and said shroud are concave.

3. The combustor of claim 1 wherein said apertures have a total area at least twice the total area of said holes.

4. The combustor of claim 1 wherein said passages are sized so that the velocity of the air flow therein corresponds to a Mach number range of about 0.15 to about 0.25.

5. The combustor of claim 4 wherein said passages are sized to a width of about 0.030 to about 0.080 inches.

6. The combustor of claim 5 wherein said passages includes an enlarged portion in fluid communication with said apertures for providing static pressure recovery to the air flowing therethrough.

7. The combustor of claim 6 wherein said holes and said apertures are equi-circumferentially spaced.

* * * * *